US006395699B1

(12) United States Patent
Kitamura et al.

(10) Patent No.: US 6,395,699 B1
(45) **Date of Patent: *May 28, 2002**

(54) METHOD OF REMOVING GREASE, OIL OR FLUX FROM AN ARTICLE

(75) Inventors: Kenroh Kitamura; Michino Ikehata, both of Yokohama; Masaaki Tsuzaki, Ichihara, all of (JP)

(73) Assignee: Asahi Glass Company Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/696,192

(22) Filed: Aug. 13, 1996

(30) Foreign Application Priority Data

Aug. 14, 1995 (JP) ..... 7-207221
Oct. 19, 1995 (JP) ..... 7-271583

(51) Int. Cl.[7] ..... C11D 17/00
(52) U.S. Cl. ..... 510/410; 510/176; 510/177; 510/244; 510/256; 510/273; 510/365

(58) Field of Search ..... 510/410, 411, 510/176, 177, 244, 256, 273, 365; 252/67

(56) References Cited

U.S. PATENT DOCUMENTS

| | | | | | |
|---|---|---|---|---|---|
| 4,810,403 | A | * | 3/1989 | Bivens et al. | 252/67 |
| 5,116,525 | A | * | 5/1992 | Merchant | 252/171 |
| 5,116,526 | A | * | 5/1992 | Magid et al. | 252/172 |
| 5,288,819 | A | * | 2/1994 | Magid et al. | 252/172 |
| 5,320,683 | A | | 6/1994 | Samejima et al. | 134/40 |
| 5,607,912 | A | * | 3/1997 | Samejima et al. | 510/411 |

FOREIGN PATENT DOCUMENTS

| | | |
|---|---|---|
| EP | 0450854 | * 10/1991 |
| WO | 91/19019 | * 12/1991 |

* cited by examiner

*Primary Examiner*—Necholus Ogden
(74) *Attorney, Agent, or Firm*—Oblon, Spivak, McClelland, Maier & Neustadt, P.C.

(57) ABSTRACT

A solvent composition comprising (a) dichloropentafluoropropane, (b) trans-1,2-dichloroethylene and (c) methanol, wherein the proportions of (a), (b) and (c) in the total amount of (a), (b) and (c) are from 57 to 75 wt %, from 20 to 35 wt % and from 5 to 8 wt %, respectively.

11 Claims, No Drawings

METHOD OF REMOVING GREASE, OIL OR FLUX FROM AN ARTICLE

BACKGROUND OF THE INVENTION

1. Field of the Invention

The present invention relates to a solvent composition useful for a degreasing agent, a defluxing agent, a water-displacement agent or the like which is an agent for removing grease, oil, flux or water attached to an article such as a printed circuit board, an electronic component such as IC, a precision machine part or a glass substrate.

2. Discussion of Background 1,1,2-trichloro-1,2,2-trifluoroethane (hereinafter referred to simply as R113), a solvent mixture composition of this R113 with a solvent soluble therein, or 1,1,1,-trichloroethane, which is excellent in nonflammability, low toxicity and stability, is widely used for various degreasing agents, defluxing agents, etc. R113 has a characteristic such that it selectively dissolves various soils without damaging a precision machine component or a substrate of e.g. metal, plastic or elastomer. Accordingly, it was most suitable for cleaning various electronic components, precision machine parts, optical parts, etc. made of metals, plastics, elastomers, etc.

R113 and 1,1,1-trichloroethane which have been heretofore used, have various merits. However, since they are chemically very stable, they have long atmospheric lifetime and diffuses to the stratosphere, where they will be decomposed by ultraviolet radiation from the sun to release chlorine radicals. Such chlorine radicals will initiate a chain reaction with ozone and deplete the ozone layer. Accordingly, regulations for limiting their production and consumption have been implemented. Therefore, a research has been actively conducted to develop an alternative solvent which scarcely depletes the ozone layer and which is useful as a substitute for conventional R113 or 1,1,1-trichloroethane.

U.S. Pat. No. 5,116,525 discloses azeotropic compositions comprising dichloropentafluoropropane (hereinafter referred to simply as R225), trans-1,2-dichloroethylene (hereinafter referred to simply as t-DE), and methanol (hereinafter referred to simply as MeOH), ethanol (hereinafter referred to simply as EtOH) or isopropanol.

Among them, disclosed as a composition containing MeOH, is an azeotropic composition which comprises from 47 to 57 wt % of R225 comprising from 50 to 75 wt % of 3,3-dichloro-1,1,1,2,2-pentafluoropropane (hereinafter referred to simply as R225ca) and from 25 to 50 wt % of 1,3-dichloro-1,1,2,2,3-pentafluoropropane (hereinafter referred to simply as R225cb), from 38 to 48 wt % of t-DE and from 3 to 9 wt % of MeOH, and which has a boiling point of 43.7° C. under atmospheric pressure of 760 mmHg.

However, it has been found by the present inventors that the above azeotropic composition gives a damage to the material of the article to be cleaned and also has inflammability.

SUMMARY OF THE INVENTION

It is a first object of the present invention to provide a solvent composition comprising R225, t-DE and MeOH, which satisfies the excellent properties which R113 or 1,1,1-trichloroethane has, which can be used as an alternative solvent which gives little influence to the ozone layer and which presents no influence over the material of an article to be cleaned and has no inflammability.

On the other hand, the above-mentioned patent specification discloses, as a composition containing EtOH, an azeotropic composition which comprises from 47 to 57 wt %, preferably 51.7 wt %, of R225 comprising from 50 to 75 wt % of R225ca and from 25 to 50 wt % of R225cb, from 40 to 50 wt %, preferably from 45.3 wt %, of t-DE, and from 1 to 5 wt %, preferably 3 wt %, of EtOH, and which has a boiling point of 46.5° C. under atmospheric pressure of 760 mmHg.

However, it has been found by the present inventors that the above azeotropic composition is not a true azeotropic composition, and it tends to undergo a compositional change.

Accordingly, a second object of the present invention is to provide an azeotropic-like solvent composition having a true composition comprising R225, t-DE and EtOH, which satisfies the excellent properties which R113 or 1,1,1,-triclhoroethane has, which is useful as an alternative solvent which gives little influence to the ozone layer and which undergoes no substantial compositional change.

The present invention provides a solvent composition (hereinafter referred to simply as composition X) comprising (a) R225, (b) t-DE and (c) MeOH, wherein the proportions of (a), (b) and (c) in the total amount of (a), (b) and (c) are from 57 to 75 wt %, from 20 to 35 wt % and from 5 to 8 wt %, respectively.

Further, the present invention provides an azeotropic-like solvent composition (hereinafter referred to simply as composition Y) comprising (a) R225, (b) t-DE and (d) EtOH, wherein the proportions of (a), (b) and (d) in the total amount of (a), (b) and (d) are from 30 to 43 wt %, from 53 to 65 wt % and from 2 to 5 wt %, respectively.

DETAILED DESCRIPTION OF THE PREFERRED EMBODIMENTS

In the present invention, R225 represents one or more of dichloropentafluoropropanes represented by the molecular formula $C_3HCl_2F_5$. R225 is preferably at least one member selected from the group consisting of R225ca and R225cb. Particularly preferred R225 is a mixture of R225ca and R225cb. The blend ratio is preferably R225ca/R225cb=1 to 99 wt %/1 to 99 wt %, more preferably R225ca/R225cb=40 to 75 wt %/25 to 60 wt %.

Composition X of the present invention comprises (a) R225, (b) t-DE and (c) MeOH, wherein the proportions of (a), (b) and (c) in the total amount of (a), (b) and (c) are from 57 to 75 wt %, from 20 to 35 wt % and from 5 to 8 wt %, respectively. Preferred proportions of (a), (b) and (c) in the total amount of (a), (b) and (c) are from 61 to 67 wt %, from 27 to 32 wt % and from 6 to 7 wt %, respectively.

Whereas, composition Y of the present invention comprises (a) R225, (b) t-DE and (d) EtOH, wherein the proportions of (a), (b) and (d) in the total amount of (a), (b) and (d) are from 30 to 43 wt %, from 53 to 65 wt % and from 2 to 5 wt %, respectively. In composition Y of the present invention, preferred proportions of (a), (b) and (d) in the total amount of (a), (b) and (d) are from 40 to 43 wt %, from 53 to 57 wt % and from 2 to 4 wt %, respectively. More preferred proportions are 41.6 wt %, 55.1 wt % and 3.3 wt %, respectively. The composition wherein (a):(b):(d) =41.6:55.1:3.3 wt %, has a boiling point of 44.6° C. under atmospheric pressure of 757 mmHg.

In the present invention, the azeotropic-like composition is meant for a composition whereby the difference in composition between the gas phase and the liquid phase is within 1% with R225, within 1% with t-DE and within 0.5% with EtOH, and the boiling point is within a range of 44.6±0.1° C. under atmospheric pressure of 757 mmHg.

Composition X of the present invention may contain the following compounds in addition to the above-mentioned (a), (b) and (c) in a range not to interfere with the first purpose of the present invention. Likewise, composition Y of the present invention may contain the following compounds in addition to the above-mentioned (a), (b) and (d) within a range not to interfere with the second object of the present invention.

Mainly for the purpose of controlling the solubility, one or more of the following compounds may be added to the compositions of the present invention within a range of from 0.1 to 50 wt %, preferably from 0.1 to 30 wt %, more preferably from 0.1 to 20 wt %.

Hydrocarbons such as n-pentane, 2-methybutane, 2,2-dimethylpropane, n-hexane, 3-methylpentane, 2,2-dimethylbutane, 2,3-dimethylbutane, n-heptane, 2-methylhexane, 3-methylhexane, 2,3-dimethylpentane, 2,4-dimethylpentane, n-octane, 2,2,3-trimethylpentane, 2,2,4-trimethylpentane, cyclopentane, cyclohexane, methylcyclohexane, and ethylcyclohexane.

Chlorinated hydrocarbons such as dichloromethane, cis-1,2-dichloroethylene, trichloroethylene, and tetrachloroethylene.

Ketones such as acetone, methyl ethyl ketone, methyl butyl ketone, and methyl isobutyl ketone.

Ethers such as diethyl ether, methylcellusolve, tetrahydrofuran, and 1,4-dioxane.

Hydrochlorofluorocarbons such as 2,2-dichloro-1,1,1-trifluoroethane, and 1,1-dichloro-1-flouroethane.

Esters such as methyl acetate, ethyl acetate, propyl acetate, and butyl acetate.

Alcohols such as methanol, ethanol, 1-propanol, 2-propanol, 1-butanol, 2-butanol, isobutanol, and t-butanol.

Mainly for the purpose of improving the stability, one or more of the following compounds may, for example, be incorporated to the compositions of the present invention with a range of from 0.001 to 10 wt %, preferably from 0.001 to 5 wt %.

Nitro compounds such as nitromethane, nitroethane, nitropropane, and nitrobenzene.

Amines such as diethylamine, triethylamine, i-propylamine, n-butylamine, and i-butylamine.

Phenols such as phenol, o-cresol, m-cresol, p-cresol, thymol, p-t-butylphenol, t-butylcatechol, catechol, isoeugenol, o-methoxyphenol, bisphenol A, isoamyl salicylate, bezyl salicylate, methyl salicylate, and 2,6-di-t-butyl-p-cresol.

Triazoles such as 2-(2'-hydroxy-5'-methylphenyl) benzotriazole, 2-(2'-hydroxy-3'-t-butyl-5'-methylphenyl)-5-chlorobenzotriazole, 1,2,3-benzotriazole, and 1 -[(N,N-bis-2-ethylhexyl)aminomethyl]benzotriazole.

Composition X of the present invention comprises R225, t-DE and MeOH in the specific proportions and thus is an excellent composition which presents no damage to the material of an article to be cleaned, such as plastics or rubbers, including e.g. rigid polyvinyl chloride, polystyrene, polycarbonate, polyphenylene oxide, ABS resin and EPDM elastomer, and which has nonflammability.

Composition Y of the present invention comprises R225, t-DE and EtOH in the specific proportions and is an azeotropic-like composition. Accordingly, it is an excellent composition which can be used with no substantial compositional change even when evaporated.

Further, the compositions of the present invention have a merit that they give little influence to the ozone layer, as the ozone depleting potential of R225 is about 1/25 of the ozone depleting potential of R113, i.e. while conventional R113 has an ozone depleting potential of 0.8, R225ca has a potential of 0.025, and R225cb has a potential of 0.33.

Further, the compositions of the present invention have a solvency substantially equivalent to conventional R113 or 1,1,1-trichloroethane, and thus they can be suitably used for various applications. Specific applications may, for example, include a cleaning agent for removing a soil such as grease, oil, flux, wax or ink from various soiled objects, a coating solvent, or an extracting agent. Further, they may be useful for a dust-removing agent for removing various dusts deposited on various articles made of glass, ceramics, plastics, elastomers or metals. Especially, they are suitable for a cleaning agent for removing various soils attached to articles such as ICs, electronic devices, precision machines and optical lenses.

They are particularly preferably used for a method of removing from an article, grease, oil or flux attached thereto.

As the cleaning method, manual wiping, dipping, spraying, shaking, ultrasonic cleaning, vapor degreasing or a combination thereof, may be used.

Now, the present invention will be described in further detail with reference to Examples. However, it should be understood that the present invention is by no means restricted to such specific Examples.

The following Examples 1 to 10, 13 to 17 and 19 to 32 represent Working Examples of the present invention, and Examples 11, 12, 18 and 33 to 36 represent Comparative Examples.

EXAMPLES 1 TO 5

Using a solvent composition as identified in Table 1, a test for degreasing was carried out. Namely, a SUS-304 test piece (25 mm×30 mm×2 mm) was immersed in machine oil (Dafunicut AS-40H, manufactured by Idemitsu Petrochemical Co., Ltd.) and then immersed for five minutes in the solvent composition as identified in Table 1. The machine oil removal degree was evaluated (◎: excellently removed, Δ: slightly remained, X: substantially remained). The results are shown in column A in Table 1.

Likewise, using a solvent composition as identified in Table 1, a test for defluxing was carried out. Namely, flux (Speedy Flux AGF-J-I, manufactured by Asahi Kagaku Kenkyusho) was coated on the entire surface of a printed circuit board (50 mm×100 mm×1.6 mm) made of glass reinforced epoxy, and soldered at a soldering temperature of 260° C. by a wave soldering machine, followed by immersing for 3 minutes in the solvent composition as identified in Table 1 for cleaning. The flux removal degree was evaluated (◎: excellently removed, Δ: slightly remained, X: substantially remained). The results are shown in column B in Table 1.

EXAMPLES 6 TO 10 AND EXAMPLE 11 AND 12

Using a solvent composition as identified in Table 2, a test for influence to the material was carried out. Namely, test pieces (25 mm×30 mm×2 mm) of rigid polyvinyl chloride (C), polystyrene (D), polycarbonate (E), polyphenylene oxide (F), ABS resin (G) and EPDM rubber (H) were immersed for 5 minutes at 50° C. in the solvent composition as identified in Table 2. The material compatibility was evaluated (◎: no change observed, ○: slight swelling observed, but no remarkable change observed, Δ: substantial swelling observed, X: dissolution or cracking observed). The results are shown in the respective columns in Table 2.

EXAMPLES 13 TO 17 AND EXAMPLE 18

Using a solvent composition as identified in Table 3, a test for inflammability was carried out. Namely, the flash point of the solvent composition as identified in Table 3 was evaluated by a Cleveland open cup type flash point measuring apparatus. The results are shown in Table 3.

TABLE 1

| Example No. | Solvent composition | wt % | A | B |
|---|---|---|---|---|
| 1 | R225 (ca:cb)/t-DE/MeOH | 57 (75:25)/35/8 | ◎ | ◎ |
| 2 | R225 (ca:cb)/t-DE/MeOH | 75 (1:99)/20/5 | ◎ | ◎ |
| 3 | R225 (ca:cb)/t-DE/MeOH | 61 (10:90)/32/7 | ◎ | ◎ |
| 4 | R225 (ca:cb)/t-DE/MeOH | 67 (99:1)/27/6 | ◎ | ◎ |
| 5 | R225 (ca:cb)/t-DE/MeOH | 64 (45:55)/30/6 | ◎ | ◎ |

TABLE 2

| Example No. | Solvent composition | wt % | C | D | E | F | G | H |
|---|---|---|---|---|---|---|---|---|
| 6 | R225(ca:cb)/ t-DE/MeOH | 57(75:25)/35/8 | ◎ | ○ | ○ | ○ | ○ | ◎ |
| 7 | R225(ca:cb)/ t-DE/MeOH | 75(1:99)/20/5 | ◎ | ○ | ○ | ○ | ○ | ◎ |
| 8 | R225(ca:cb)/ t-DE/MeOH | 61(10:90)/32/7 | ◎ | ○ | ○ | ○ | ○ | ◎ |
| 9 | R225(ca:cb)/ t-DE/MeOH | 67(99:1)/27/6 | ◎ | ○ | ○ | ○ | ○ | ◎ |
| 10 | R225(ca:cb)/ t-DE/MeOH | 64(45:55)/30/6 | ◎ | ○ | ○ | ○ | ○ | ◎ |
| 11 | R225(ca:cb)/ t-DE/MeOH | 47(75:25)/44/9 | Δ | X | X | X | X | Δ |
| 12 | R225(ca:cb)/ t-DE/MeOH | 52(50:50)/42/6 | Δ | X | X | X | X | Δ |

TABLE 3

| Example No. | Solvent composition | wt % | Flash point |
|---|---|---|---|
| 13 | R225 (ca:cb)/t-DE/MeOH | 57 (75:25)/35/8 | None |
| 14 | R225 (ca:cb)/t-DE/MeOH | 75 (1:99)/20/5 | None |
| 15 | R225 (ca:cb)/t-DE/MeOH | 61 (10:90)/32/7 | None |
| 16 | R225 (ca:cb)/t-DE/MeOH | 67 (99:1)/27/6 | None |
| 17 | R225 (ca:cb)/t-DE/MeOH | 64 (45:55)/30/6 | None |
| 18 | R225 (ca:cb)/t-DE/MeOH | 47 (45:55)/44/9 | 32° C. |

EXAMPLE 19

250 cc of a solvent composition comprising R225, t-DE and EtOH in various proportions was put into an Othmer type gas-liquid equilibrium distillation apparatus and heated to an equilibrium state, whereupon the gas phase and the liquid phase were sampled and analyzed by gas chromatograph. The results are shown in Table 4. From the results, it is evident that the azeotropic-like range of the composition of the present invention is such that R225 is from 30 to 43 wt %, t-DE is from 53 to 65 wt %, and EtOH is from 2 to 5 wt %. The composition comprising 41.6 wt % of R225, 55.1 wt % of t-DE and 3.3 wt % of EtOH, has a boiling point of 44.6° C. under atmospheric pressure of 757 mmHg.

EXAMPLE 20

To confirm the azeotropic-like composition, 1,000 g of an azeotropic-like solvent composition comprising 41.6 wt % of R225, 55.1 wt % of t-DE and 3.3 wt % of EtOH, was put into a distillation flask, which was then attached to a fractionating column with a theoretical plate number of 5 plates. Then, the azeotropic-like solvent composition was heated and refluxed for 2 hours to reach an equilibrium state, whereupon fractions were collected as the time passes and analyzed by gas chromatograph. The results are shown in Table 5.

EXAMPLE 21

20 kg of a solvent composition comprising 30 wt % of R225, 65 wt % of t-DE and 5 wt % of EtOH, was put into a small size one sump cleaning machine and operated for 6 hours per day for 3 days. As the time passed, samples were taken from the cleaning sump and the water separator, respectively, and analyzed by gas chromatograph. The results are shown in Table 6.

EXAMPLE 22

The operation was carried out in the same manner as in Example 21 except that 20 kg of a solvent composition comprising 43 wt % of R225, 53 wt % of t-DE and 4 wt % of EtOH, was used. The results are shown in Table 6.

EXAMPLE 23

The operation was carried out in the same manner as in Example 22 except that 20 kg of a solvent composition comprising 40 wt % of R225, 58 wt % of t-DE and 2 wt % of EtOH, was used. The results are shown in Table 6.

EXAMPLE 24

The operation was carried out in the same manner as in Example 21 except that 20 kg of a solvent composition comprising 41.6 wt % of R225, 55.1 wt % of t-DE and 3.3 wt % of EtOH, was used. The results are shown in Table 6.

EXAMPLES 25 TO 32

Using an azeotropic-like solvent composition as identified in table 7, a test for degreasing was carried out. Namely, a SUS 304 test piece (25 mm×30 mm×2 mm) was immersed in machine oil (Dafunicut AS-40H, manufactured by Idemitsu Petrochemical Co., Ltd.) and then immersed for 5 minutes in the azeotropic-like solvent composition as identified in Table 7. The machine oil removal degree was evaluated (◎: excellently removed, Δ: slightly remained, X: substantially remained). The results are shown in column a in Table 7.

Likewise, using an azeotropic-like solvent composition as identified in Table 7, a test for defluxing was carried out. Namely, flux (Speedy Flux AGF-J-I, manufactured by Asahi Kagaku Kenkyusho) was coated over the entire surface of a printed circuit board (50 mm×100 mm×1.6 mm) made of glass reinforced epoxy, and soldered at a soldering temperature of 260° C. by a wave soldering machine, followed by immersing for 3 minutes in the azeotropic-like solvent composition as identified in Table 7 for cleaning. The flux removal degree was evaluated (◎: excellently removed, Δ: slightly remained, X: substantially remained). The results are shown in column b in Table 7.

EXAMPLE 33

250 cc of a solvent composition comprising R225, t-DE and EtOH in various proportions within the ranges of from 47 to 57 wt % of R225, from 40 to 50 wt % of t-DE and from 1 to 5 wt % of EtOH, was put into an Othmer type gas-liquid equilibrium distillation apparatus and heated to an equilibrium state, whereupon the gas phase and the liquid phase were sampled and analyzed by gas chromatograph. The results are shown in Table 8.

EXAMPLE 34

1,000 g of a solvent composition comprising 51.7 wt % of R225, 45.3 wt % of t-DE and 3.0 wt % of EtOH, was put into a distillation flask, which was then attached to a fractionating column having a theoretical plate number of 5 plates. Then, the solvent composition was heated and refluxed for 2 hours to reach an equilibrium state, whereupon fractions were sampled as the time passed and analyzed by gas chromatograph. The results are shown in Table 9.

EXAMPLE 35

The operation was carried out in the same manner as in Example 21 except that 20 kg of a solvent composition comprising 47.1 wt % of R225, 50.0 wt % of t-DE and 3.0 wt % of EtOH, was used. The results are shown in Table 10

EXAMPLE 36

The operation was carried out in the same manner as in Example 21 except that 20 kg of a solvent composition comprising 57.0 wt % of R225, 42.0 wt % of t-DE and 1.0 wt % of EtOH, was used. The results are shown in Table 10.

TABLE 4

| Gas phase composition (wt %) | | | Liquid phase composition (wt %) | | | Boiling point | Pressure (mm |
|---|---|---|---|---|---|---|---|
| R225(ca:cb) | t-DE | EtOH | R225(ca:cb) | t-DE | EtOH | (° C.) | Hg) |
| 25.0(45:55) | 68.2 | 6.8 | 22.7(43:57) | 69.8 | 7.5 | 44.8 | 757 |
| 30.0(45:55) | 65.0 | 5.0 | 28.6(42:58) | 65.9 | 5.5 | 44.8 | 757 |
| 31.0(45:55) | 64.6 | 4.4 | 30.1(43:57) | 65.0 | 4.9 | 44.7 | 757 |
| 38.7(45:55) | 59.0 | 2.3 | 38.0(42:58) | 60.0 | 2.0 | 44.7 | 757 |
| 41.6(45:55) | 55.1 | 3.3 | 41.6(45:55) | 55.1 | 3.3 | 44.6 | 757 |
| 42.2(45:55) | 54.2 | 3.6 | 42.5(44:56) | 53.7 | 3.8 | 44.6 | 757 |
| 43.0(45:55) | 53.6 | 3.4 | 43.9(43:57) | 52.5 | 3.6 | 44.7 | 757 |
| 45.1(45:55) | 52.1 | 2.8 | 46.5(44:56) | 50.1 | 3.4 | 44.8 | 757 |

TABLE 5

| Distilled amount | Composition (wt %) | | | Boiling point | Pressure |
|---|---|---|---|---|---|
| (wt %) | R225 (ca:cb) | t-DE | EtOH | (° C.) | (mmHg) |
| 10.1 | 42.0 (50:50) | 54.9 | 3.1 | 44.5 | 757 |
| 21.0 | 41.6 (47:53) | 55.1 | 3.3 | 44.6 | 757 |
| 35.2 | 41.6 (46:54) | 55.1 | 3.3 | 44.6 | 757 |
| 47.3 | 41.6 (45:55) | 55.1 | 3.3 | 44.6 | 757 |
| 57.6 | 41.6 (44:56) | 55.1 | 3.3 | 44.6 | 757 |
| 68.5 | 41.6 (42:58) | 55.1 | 3.3 | 44.6 | 757 |
| 78.0 | 41.0 (40:60) | 55.7 | 3.3 | 44.7 | 757 |

TABLE 6

| | Composition (wt %) | | | | | |
|---|---|---|---|---|---|---|
| | Cleaning tank | | | Water separator | | |
| Time | R225(ca:cb) | t-DE | EtOH | R225(ca:cb) | t-DE | EtOH |
| Example 21 | | | | | | |
| 6 hrs later | 30.0(10:90) | 65.0 | 5.0 | 30.0(10:90) | 65.0 | 5.0 |
| 12 hrs later | 30.0(10:90) | 65.0 | 5.0 | 30.0(11:89) | 65.0 | 5.0 |
| 18 hrs later | 30.0(11:89) | 65.0 | 5.0 | 30.2(11:89) | 64.9 | 4.9 |
| Example 22 | | | | | | |
| 6 hrs later | 43.0(95:5) | 53.0 | 4.0 | 43.0(95:5) | 53.0 | 4.0 |
| 12 hrs later | 43.0(95:5) | 53.0 | 4.0 | 43.0(96:4) | 53.0 | 4.0 |
| 18 hrs later | 43.1(96:4) | 52.9 | 4.0 | 43.0(96:4) | 53.0 | 4.0 |
| Example 23 | | | | | | |
| 6 hrs later | 40.0(1:99) | 58.0 | 2.0 | 40.0(1:99) | 58.0 | 2.0 |
| 12 hrs later | 40.0(1:99) | 58.0 | 2.0 | 40.0(1:99) | 58.0 | 2.0 |
| 18 hrs later | 40.0(1:99) | 58.0 | 2.0 | 40.1(2:98) | 57.9 | 2.0 |
| Example 24 | | | | | | |
| 6 hrs later | 41.6(45:55) | 55.1 | 3.3 | 41.6(45:55) | 55.1 | 3.3 |
| 12 hrs later | 41.6(46:54) | 55.1 | 3.3 | 41.6(45:55) | 55.1 | 3.3 |
| 18 hrs later | 41.6(46:54) | 55.1 | 3.3 | 41.6(46:54) | 55.1 | 3.3 |

TABLE 7

| Example No. | Solvent composition | wt % | a | b |
|---|---|---|---|---|
| 25 | R225 (ca:cb)/t-DE/EtOH | 30 (10:90)/65/5 | ⊙ | ⊙ |
| 26 | R225 (ca:cb)/t-DE/EtOH | 43 (99:1)/53/4 | ⊙ | ⊙ |
| 27 | R225 (ca:cb)/t-DE/EtOH | 40 (1:99)/58/2 | ⊙ | ⊙ |
| 28 | R225 (ca:cb)/t-DE/EtOH | 41.6 (45:55)/55.1/3.3 | ⊙ | ⊙ |
| 29 | R225 (ca:cb)/t-DE/EtOH/methanol | 42 (20:80)/53/4/1 | ⊙ | ⊙ |
| 30 | R225 (ca:cb)/t-DE/EtOH/2-propanol | 35 (50:50)/62/2/1 | ⊙ | ⊙ |
| 31 | R225 (ca:cb)/t-DE/EtOH/nitromethane | 41 (45:55)/55/3/1 | ⊙ | ⊙ |
| 32 | R225 (ca:cb)/t-DE/EtOH/methanol/nitromethane | 31 (90:10)/65.5/2/1/0.5 | ⊙ | ⊙ |

TABLE 8

| Gas phase composition (wt %) | | | Liquid phase composition (wt %) | | | Boiling point | Pressure (mm- |
|---|---|---|---|---|---|---|---|
| R225 (ca:cb) | t-DE | EtOH | R225 (ca:cb) | t-DE | EtOH | (° C.) | Hg) |
| 47.1 (75:25) | 49.8 | 3.1 | 48.8 (72:28) | 48.8 | 2.4 | 44.8 | 757 |
| 51.9 (60:40) | 45.2 | 2.9 | 53.5 (58:42) | 44.5 | 2.0 | 44.9 | 757 |
| 56.9 (52:48) | 42.1 | 1.0 | 58.9 (50:50) | 40.7 | 0.4 | 45.0 | 757 |

TABLE 9

| Distilled amount | Composition (wt %) | | | Boiling point | Pressure |
|---|---|---|---|---|---|
| (wt %) | R225 (ca:cb) | t-DE | EtOH | (° C.) | (mmHg) |
| 9.0 | 43.5 (83:17) | 53.6 | 2.9 | 44.7 | 760 |
| 22.1 | 41.4 (70:30) | 55.5 | 3.1 | 44.6 | 760 |
| 34.6 | 40.5 (64:36) | 56.4 | 3.2 | 44.7 | 760 |
| 48.0 | 39.7 (57:43) | 57.1 | 3.2 | 44.7 | 760 |
| 58.0 | 39.2 (53:47) | 57.7 | 3.1 | 44.8 | 760 |
| 69.5 | 38.4 (46:54) | 58.4 | 3.2 | 44.8 | 760 |
| 78.2 | 45.3 (34:66) | 51.6 | 3.2 | 46.5 | 760 |

TABLE 10

| | Composition (wt %) | | | | | |
|---|---|---|---|---|---|---|
| | Cleaning tank | | | Water separator | | |
| Time | R225(ca:cb) | t-DE | EtOH | R225(ca:cb) | t-DE | EtOH |
| Example 35 | | | | | | |
| 6 hrs later | 47.0(75:25) | 50.0 | 3.0 | 47.0(75:25) | 50.0 | 3.0 |
| 12 hrs later | 47.2(74:26) | 49.8 | 3.0 | 47.3(74:26) | 49.6 | 3.1 |
| 18 hrs later | 47.5(72:28) | 49.3 | 3.2 | 47.7(71:29) | 49.1 | 3.2 |
| Example 36 | | | | | | |
| 6 hrs later | 57.0(50:50) | 42.0 | 1.0 | 57.0(50:50) | 42.0 | 1.0 |
| 12 hrs later | 57.4(53:47) | 41.5 | 1.1 | 57.5(54:46) | 41.4 | 1.1 |
| 18 hrs later | 57.9(55:45) | 40.9 | 1.2 | 58.1(56:44) | 40.6 | 1.3 |

In Tables 1 to 10, R225 (ca:cb) represents a mixture of R225ca and R225cb. Further, numerals in a bracket for wt % represent the proportions (%) of R225ca and R225cb, respectively, for R225.

Composition X of the present invention satisfies the excellent properties which conventional R113 or 1,1,1-trichloroethane has, and has merits such that it gives no influence to the material of an article to be cleaned, it has nonflammability, and it presents little influence to the ozone layer.

Composition Y of the present invention satisfies the excellent properties which conventional R113 or 1,1,1-trichloroethane has, and has advantages such that it can be used without any substantial change in the composition, and it presents little influence to the ozone layer.

What is claimed is:

1. A method for removing from an article, grease, oil, or flux, attached on said article comprising:

i) contacting said article with the solvent composition comprising:
(a) 61 to 67 wt. % dichloropentafluoropropane;
(b) 27 to 32 wt. % of trans-1,2-dichloroethylene; and
(c) 6 to 7 wt. % methanol, wherein said dichloropentafluoropropane consists of 40 to 75 wt. % of 3,3-dichloro-1,1,1,2,2-pentafluoropropane and from 25 to 60 wt. % of 1,3-dichloro-1,1,2,2,3-pentafluoropropane, ii) evaporating and isolating a solvent composition resulting from the contacting of step i) to obtain a solvent composition comprising:
(a) 61 to 67 wt. % dichloropentafluoropropane;
(b) 27 to 32 wt. % of trans-1,2-dichloroethylene; and
(c) 6 to 7 wt. % methanol, wherein said dichloropentafluoropropane consists of 40 to 75 wt. % of 3,3-dichloro-1,1,1,2,2-pentafluoropropane and from 25 to 60 wt. % of 1,3-dichloro- 1,1,2,2,3-pentafluoropropane.

2. A method for removing from an article, grease, oil, or flux, attached on said article comprising:

i) contacting said article with the solvent composition comprising:
(a) 30 to 43 wt. % dichloropentafluoropropane;
(b) 53 to 65 wt. % of trans-1,2-dichloroethylene; and
(c) 2 to 5 wt. % ethanol, wherein said dichloropentafluoropropane consists of 40 to 75 wt. % of 3,3-dichloro-1,1,1,2,2-pentafluoropropane and from 25 to 60 wt. % of 1,3-dichloro-1,1,2,2,3-pentafluoropropane, ii) evaporating and isolating the solvent composition resulting from the contacting of step i) to obtain a solvent composition comprising:
(a) 30 to 43 wt. % dichloropentafluoropropane;
(b) 53 to 65 wt. % of trans-1,2-dichloroethylene; and
(c) 2 to 5 wt. % ethanol, wherein said dichloropentafluoropropane consists of 40 to 75 wt. % of 3,3-dichloro-1,1,1,2,2-pentafluoropropane and from 25 to 60 wt. % of 1,3-dichloro-1,1,2,2,3-pentafluoropropane.

3. The method according to claim 1, wherein the article is an IC, an electrical equipment, a precision machine or an optical lens.

4. The method according to claim 1, wherein the article is made of a plastic or an elastomer.

5. The method according to claim 4, wherein the plastic is rigid polyvinyl chloride, polystyrene, polycarbonate, polyphenylene oxide or ABS resin.

6. The method according to claim 4, wherein the elastomer is EPDM rubber.

7. The method according to claim 2, wherein the article is an IC, an electrical equipment, a precision machine or an optical lens.

8. The method of claim 1, wherein the proportions of (a), (b), and (c), in the total amount of (a), (b), and (c), are 64 wt. %, 30 wt. %, and 6 wt. %, respectively., and wherein the dichloropentafluoropropane consists of 45 wt. % of 3,3-dichloro-1,1,1,2,2,-pentafluoropropane and 55 wt. % of 1,3 dichloro-1,1,2,2,3-pentafluoropropane.

9. The method of claim 2, wherein the proportions of (a), (b), and (d) in the total amount of (a), (b), and (d), are 41.6 wt. %, 55.1 wt. % and 3.3 wt. %, respectively, and wherein the dichloropentafluoropropane consists of 45 wt. % of 3,3-dichloro-1, 1,1,2,2-pentafluoropropane and 55 wt. % of 1,3-dichloro-1,1,2,2,3-pentafluoropropane.

10. A method for removing from an article, grease, oil, or flux, attached on said article comprising contacting said article with the solvent composition comprising:

(a) 61 to 67 wt. % dichloropentafluoropropane;
(b) 27 to 32 wt. % of trans-1,2-dichloroethylene; and
(c) 6 to 7 wt. % methanol, wherein said dichloropentafluoropropane consists of 40 to 75 wt. % of 3,3-dichloro-1,1,1,2,2-pentafluoropropane and from 25 to 60 wt. % of 1,3-dichloro-1,1,2,2,3-pentafluoropropane.

11. A method for removing from an article, grease, oil, or flux, attached on said article comprising:

contacting said article with the solvent composition comprising:
a) 30 to 43 wt % dichloropentafluoropropane;
b) 53–65 wt % of trans-2,1-dichloroethylene; and
c) 2 to 5 wt % ethanol, wherein said dichloropentafluoropropane consists of 40 to 75 wt % of 1,3-dichloro 1,1,1,2,2-pentafluoropropane and from 25 to 60 wt % of 1,3-dichloro-1,1,2,2,3-pentafluoropropane.

* * * * *